US008910603B2

(12) United States Patent
Bayrakdar

(10) Patent No.: US 8,910,603 B2
(45) Date of Patent: Dec. 16, 2014

(54) DEVICE FOR VARYING THE RELATIVE ANGLE POSITION OF A CAMSHAFT WITH RESPECT TO A CRANKSHAFT OF AN INTERNAL COMBUSTION ENGINE

(75) Inventor: Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/982,602

(22) PCT Filed: Jan. 30, 2012

(86) PCT No.: PCT/EP2012/051425

§ 371 (c)(1), (2), (4) Date: Jul. 30, 2013

(87) PCT Pub. No.: WO2012/104242

PCT Pub. Date: Aug. 9, 2012

(65) Prior Publication Data

US 2013/0312677 A1 Nov. 28, 2013

(30) Foreign Application Priority Data

Feb. 3, 2011 (DE) ..... 10 2011 003 556

(51) Int. Cl.
*F01L 1/34* (2006.01)
*F01L 1/344* (2006.01)
*F01L 1/46* (2006.01)

(52) U.S. Cl.
CPC ..... *F01L 1/344* (2013.01); *F01L 1/3442* (2013.01); *F01L 2103/00* (2013.01); *F01L 2001/34426* (2013.01); *F01L 1/46* (2013.01)
USPC ..... 123/90.17; 123/90.45

(58) Field of Classification Search
CPC ..... F01L 1/3442; F01L 1/46; F01L 1/344; F01L 2103/00; F01L 2001/34426
USPC ..... 123/90.15, 90.16, 90.17, 90.45
See application file for complete search history.

(56) References Cited

U.S. PATENT DOCUMENTS

| | | | | |
|---|---|---|---|---|
| 5,566,651 | A | 10/1996 | Strauss et al. | |
| 2005/0051123 | A1 | 3/2005 | Haser et al. | |
| 2007/0095315 | A1 | 5/2007 | Hoppe et al. | |
| 2007/0119402 | A1 * | 5/2007 | Lancefield et al. | 123/90.17 |
| 2012/0145105 | A1 | 6/2012 | Bayrakdar | |

FOREIGN PATENT DOCUMENTS

| | | | |
|---|---|---|---|
| DE | 4218082 | A1 | 12/1993 |
| DE | 10211468 | A1 | 9/2003 |

(Continued)

*Primary Examiner* — Zelalem Eshete
(74) *Attorney, Agent, or Firm* — Davidson, Davidson & Kappel, LLC

(57) ABSTRACT

A device for varying the relative angle position of a camshaft with respect to a crankshaft of an internal combustion engine. A circlip fixes the valve housing in a positively locking manner. The circlip has at least one radially extending circumferential portion which is designed to engage into an annular groove arranged in the camshaft or in the rotor in the axial end region of said camshaft or rotor, wherein the circlip has at least one axially extending retaining portion, wherein the control piston has, in one of the face regions thereof, an annular groove which is designed for the engagement of the at least one axially extending retaining portion, and wherein the valve housing has, in one of its face regions, at least one hook-shaped portion for engaging behind at least one radially extending circumferential portion of the circlip.

11 Claims, 6 Drawing Sheets

(56) References Cited

FOREIGN PATENT DOCUMENTS

| | | | |
|---|---|---|---|
| DE | 102009039085 | A1 | 3/2011 |
| DE | 102009039384 | A1 | 3/2011 |
| FR | 2836438 | A1 | 8/2003 |
| WO | WO 9208060 | A1 | 5/1992 |

* cited by examiner

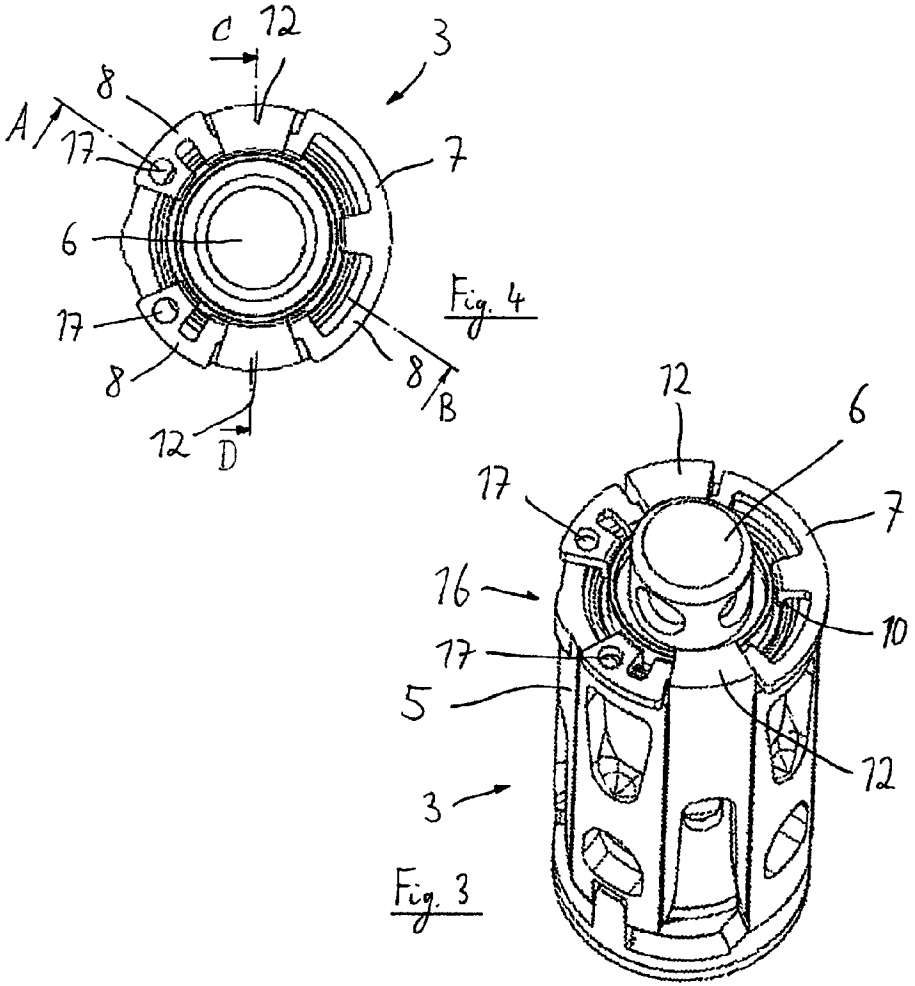
Fig. 4
Fig. 3
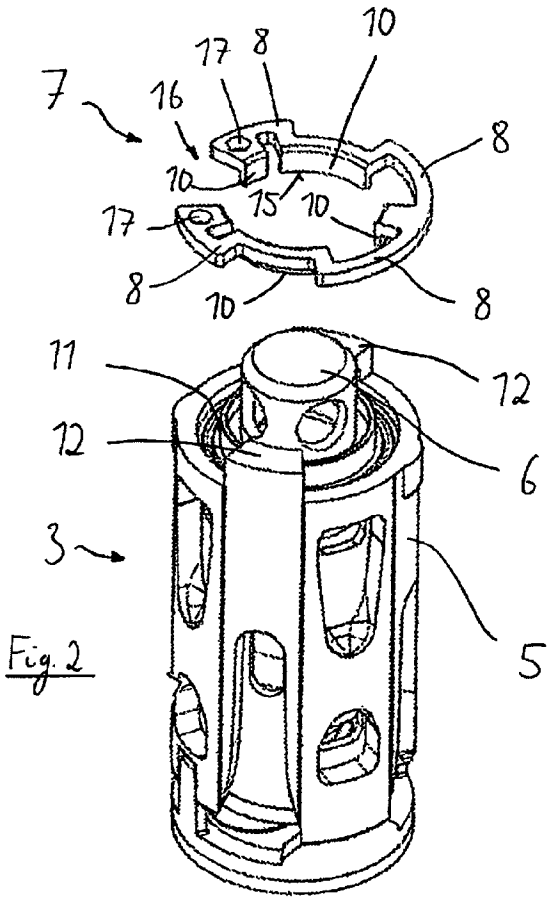
Fig. 2

DEVICE FOR VARYING THE RELATIVE ANGLE POSITION OF A CAMSHAFT WITH RESPECT TO A CRANKSHAFT OF AN INTERNAL COMBUSTION ENGINE

The invention relates to a device for varying the relative angle position of a camshaft with respect to a crankshaft of an internal combustion engine, wherein the device has a drive element driven by the crankshaft and a rotor connected to the camshaft in a non-rotatable manner, wherein at least two hydraulic chambers are configured between the drive element and the rotor, which hydraulic chambers can be acted upon by a hydraulic fluid, in order to set a defined relative rotational position between the drive element and the rotor, wherein the device for controlling the hydraulic fluid has a control valve, which may be arranged in a bore in the camshaft or in the rotor, wherein the control valve has a valve housing which is adapted to the dimensions of the bore and which is of substantially hollow cylindrical form, wherein a control piston is arranged in an axially displaceable manner in the valve housing and wherein a circlip is provided for fixing the valve housing in the camshaft or in the rotor in a form-fitting manner.

BACKGROUND

Camshaft-adjusting devices, particularly those that work hydraulically, are mainly used in internal combustion engines. Insofar as the camshaft adjuster works hydraulically, as is typical, it exhibits an impeller, in which blades are incorporated or arranged. The blades are located in hydraulic chambers, which are incorporated in a drive element (also referred to as an external rotor or stator). Through the corresponding application of hydraulic fluid to the respective side of the hydraulic chambers, the internal rotor (connected to the camshaft) may be adjusted relative to the external rotor between an "early limit stop" and a "late limit stop". The flow of hydraulic oil in this case is controlled by an electrically actuated directional valve. The transmission of the rotational movement of the crankshaft to the external rotor mainly takes place via a gear-wheel, to which the external rotor is connected in a non-rotatable manner. A camshaft adjuster and also a control valve of the aforementioned kind is disclosed in DE 102 11 468 A1, for example. In this solution, the device has a vane-type design. Other variants are also known, however, such as axial piston adjusters from DE 42 18 082 A1, for example.

The camshaft is mounted in a cylinder head of the internal combustion engine by means of a plurality of camshaft bearings. Hydraulic fluid is supplied to a hydraulic fluid channel formed in the camshaft via one of the camshaft bearings, which hydraulic fluid can be conducted into the pressure chambers via the control valve, which is arranged in a receiving part of the camshaft.

The control valve comprises a valve housing and a control piston contained in the valve housing in an axially displaceable manner. The control piston may be positioned by means of an electromagnetic actuator against the force of a spring element in an axial direction relative to the valve housing and thereby control the hydraulic fluid flows.

A circlip may be used to fix the valve housing. In this case, a form-fit fixing of the valve housing in the camshaft or in the rotor is achieved by means of the circlip. A solution of this kind is disclosed in DE 10 2009 039 085 A1 and DE 10 2009 039 384 A1.

SUMMARY OF THE INVENTION

A disadvantageous feature of this solution known in the art is that assembly of the control valve in the camshaft or rotor is sometimes difficult and requires special tools. The financial expenditure involved in producing the camshaft adjuster is correspondingly high, as a result of the intricate assembly.

The problem addressed by the present invention is that of developing a device of the kind referred to above, such that it is possible to carry out the assembly with less effort. Attention is directed in this case to the fact that it should be possible to fit the control valve in its receiving bore in the camshaft or else in the rotor without tools wherever possible and therefore ensure a perfect, form fit of the valve.

It is an object of the present invention to provide a circlip that has at least one radially extending circumferential portion, which is designed to engage with an annular groove arranged in the camshaft or in the rotor in the axial end region of said camshaft or said rotor, wherein the circlip has at least one axially extending retaining portion, wherein the control piston has an annular groove in one of its face regions, which is designed for the engagement of at least one axially extending retaining portion, and wherein the valve housing has at least one hook-shaped portion for engaging behind at least one circumferential portion of the circlip in one of its face regions.

The present invention provides a circlip preferably having an L-shaped design in the radial section, at least sectionally.

A spring element effective in an axial direction can be arranged between the valve housing and the control piston.

The bore in the camshaft or in the rotor may have a ledge to create an axial limit stop for the valve housing. The bore diameter is preferably reduced for this purpose to create the ledge.

The circlip may be designed such that its at least one axially extending retaining portion forms an axial limit stop for the control piston in the assembled state of the device.

The valve housing together with the control piston are preferably configured by the circlip prior to assembly in the device as a preassembled unit, in that the at least one axially extending retaining portion is arranged in the annular groove of the control piston, while at the same time, a circumferential portion is arranged under the at least one hook-shaped portion. In this way, the aforementioned unit may be supplied as such to the assembly line of the camshaft adjuster and easily fitted there.

The circlip preferably has at least two axially extending retaining portions, wherein said retaining portions are arranged on opposite circumferential points of the circlip to one another. Furthermore, it is preferably provided that the circlip has at least two radially extending circumferential portions, wherein these are arranged at opposite circumferential points of the circlip to one another. Furthermore, the valve housing preferably has two hook-shaped portions, wherein these are arranged at opposite circumferential points of the valve housing to one another.

The circlip preferably has a gap at one circumferential point, wherein recesses, particularly bores, for engagement of an assembly or dismantling tool (pliers for the circlip) are arranged in the portions of the circlip adjacent to the gap.

The proposed embodiment can generally be used for valve arrangements of a camshaft adjuster, wherein the valve is particularly designed as a plug-in solution, i.e. it is inserted in the bore in the camshaft or in the rotor.

Only the form-fit locking of the valve housing of the control valve by circlip had been previously disclosed; a further solution now exists, which allows a preassembled unit to be provided and easily fitted—as will be seen below—namely preferably entirely without assembly tools. Hitherto, not only were special tools (circlip pliers) usually required for assembly, but assembly, moreover, was also difficult and time-consuming and therefore expensive.

The aforementioned problem can be entirely solved with the proposed design, in that an assembly is provided which can be fitted into the camshaft adjuster very easily. Dismantling is also easily possible.

The circlip fixes the control piston and also the spring element in the valve housing in an undetachable and preassembled manner. An advantageous transport securing device therefore also exists, which is provided until the unit is fitted in the camshaft adjuster.

The circlip also advantageously offers an axial limit stop for the control piston. The prestressing of the spring element already exists in the preassembled unit and during assembly of the unit.

Assembly can be carried out very easily through the application of an axial force on the control piston, when the control valve is inserted into its receiving bore in the camshaft or in the rotor. A reliable securing device preventing components of the control valve from becoming detached from the camshaft adjuster is also thereby provided.

The circlip is preferably made of metal or also of plastic. In the case of a metal embodiment, cost-effective manufacture can be achieved by forming processes.

BRIEF DESCRIPTION OF THE DRAWINGS

Exemplary embodiments of the invention are presented in the drawings. In the drawings:

FIG. 2 shows an exploded view of the control valve of the camshaft adjuster, wherein a circlip of the control valve is represented separately from the valve housing along with the control piston, FIG. 3 shows the control valve of the camshaft adjustor preassembled as a unit in perspective view, FIG. 4 shows the side view of the control valve according to FIG. 4, viewed in the axial direction.

DETAILED DESCRIPTION

Figure 1:
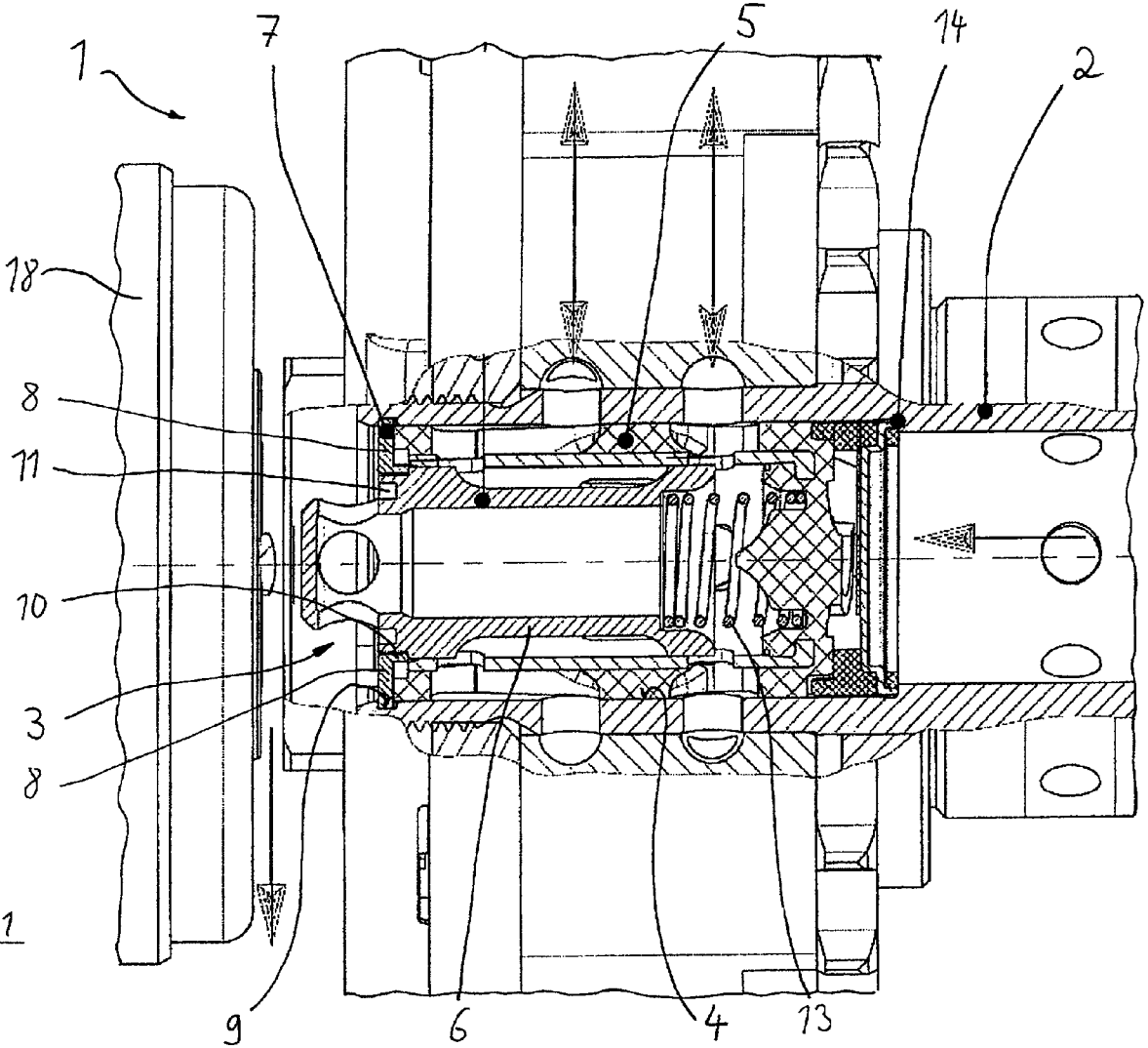
FIG. 1 shows a camshaft adjuster of an internal combustion engine represented as a radial cross section, wherein the adjuster is ready assembled.

Depicted in FIG. 1 is a ready assembled device for varying the relative angle position between the crankshaft and the camshaft 2 of an internal combustion engine, i.e. a camshaft adjuster. The camshaft 2 has a bore 4 in the present case, which is provided to accommodate a control valve 3. So that the control valve 3 (on the right in FIG. 1) has a defined limit stop, the bore 4 is reduced in diameter in the right-hand region of the camshaft 2, so that a ledge 14 is produced, against which the control valve 3 bears axially in the assembled state.

The control valve 3 has a valve housing 5, in which a control piston 6 is arranged in an axially displaceable manner. The control piston 6 may be axially displaced into a desired position by an electromagnetic actuator 18. The control piston 6 is axially prestressed relative to the valve housing 5 using a spring element 13 (helical spring). This design is as such known in the prior art.

In the ready assembled installation position, the valve housing 5 is axially secured by a circlip 7, in that the radially elastic circlip 7 is arranged in an annular groove 9 in the camshaft 2. The annular groove 9 is turned into the inside of the bore 4.

The circlip 7 has a particular design; the control valve 3 and particularly the valve housing 5 and the control piston 6 are adapted and designed in a particular manner for interaction with the circlip 9.

The circlip 7 has a plurality of radially extending circumferential portions 8—as can be best seen in the overview of FIGS. 2 to 4 and particularly in the perspective representation of the circlip 7 according to FIG. 2—which are provided in the fitted state of the camshaft adjuster for engagement with the annular groove 9, which is incorporated in the camshaft 2 in the axial end region thereof. The circlip 7 further has a plurality of axially extending retaining portions 10. The control piston 6 furthermore has in its one axial end section, i.e. in its one front side, an annular groove 11 (preferably see FIG. 1), which is provided and designed for engagement of the axially extending retaining portions 10. Finally, the valve housing 5—as is best depicted in FIG. 2—has two hook-shaped portions 12 in its one axial end region, i.e. in its one front side, which are provided to engage behind a circumferential portion of the circlip 7. The axially extending retaining portions 10 have axial limit stops 15, which create an axial limit stop for the control piston 6 in the assembled state of the camshaft adjuster.

For the handling of the circlip 7, the latter has a gap at one circumferential point 16, so that the circlip can be elastically widened. For this purpose, a tool (not shown) in the form of pliers can engage with recesses 17, which are incorporated in the region of the circlip 7 bordering the gap.

As can be seen in the overview in FIGS. 2 to 4, it is therefore possible to configure a structural unit comprising a valve housing 5 and control piston 6 along with a circlip 7, which can be provided as a unit for assembly into the camshaft adjustor or in the camshaft. This unit is designed in a non-detachable manner and is easy to handle.

The fitting of the control valve 3 in the form of a unit in the camshaft adjuster is illustrated in FIGS. 5 to 10.

Figure 5:
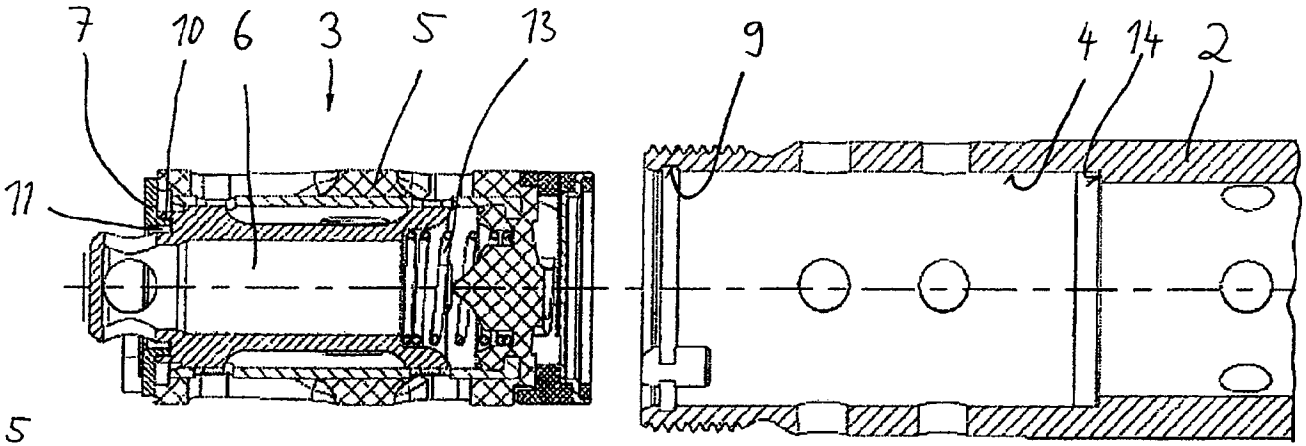
FIG. 5 shows the control valve to be assembled before it is pushed into the receiving bore in the camshaft, wherein the control valve is represented in section A-B according to FIG. 4.
Figure 6:
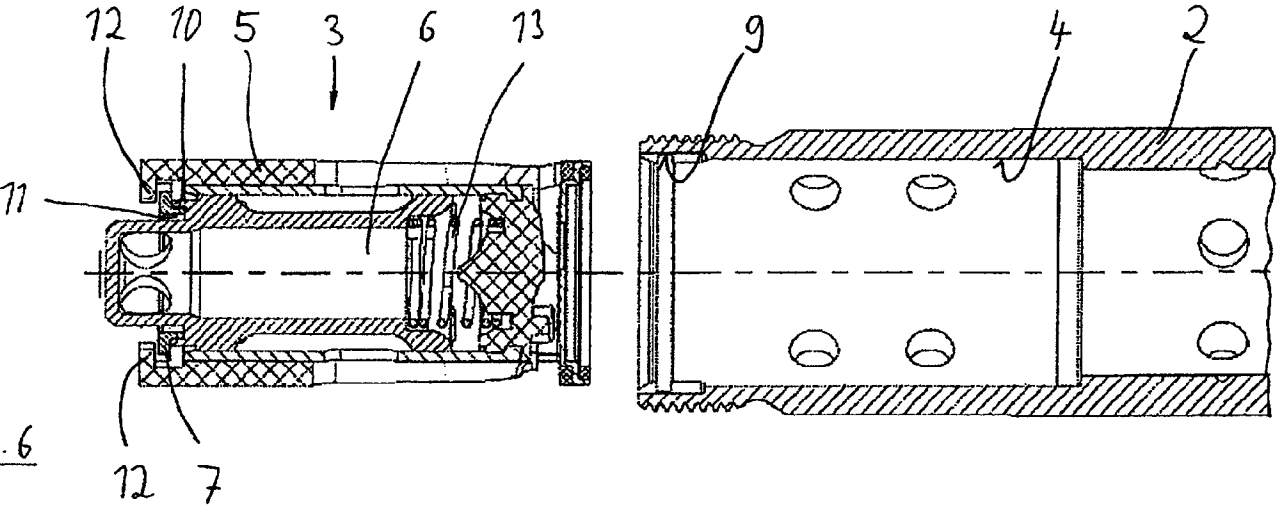
FIG. 6 shows the control valve to be assembled before it is inserted into the receiving bore in the camshaft according to FIG. 5, wherein the control valve is represented in section C-D according to FIG. 4.

The unit of the control valve 3 can be seen in two different sectional views in FIGS. 5 and 6, before it is inserted into the bore 4 of the camshaft 2. It can be seen that the circlip 7 in this case is axially retained by the two hook-shaped portions 12 of the valve housing 5, while the axially extending retaining portions 10 engage with the annular groove 11 in the control piston 6. The spring element 13 ensures an inner prestressing of the unit.

Figure 7:
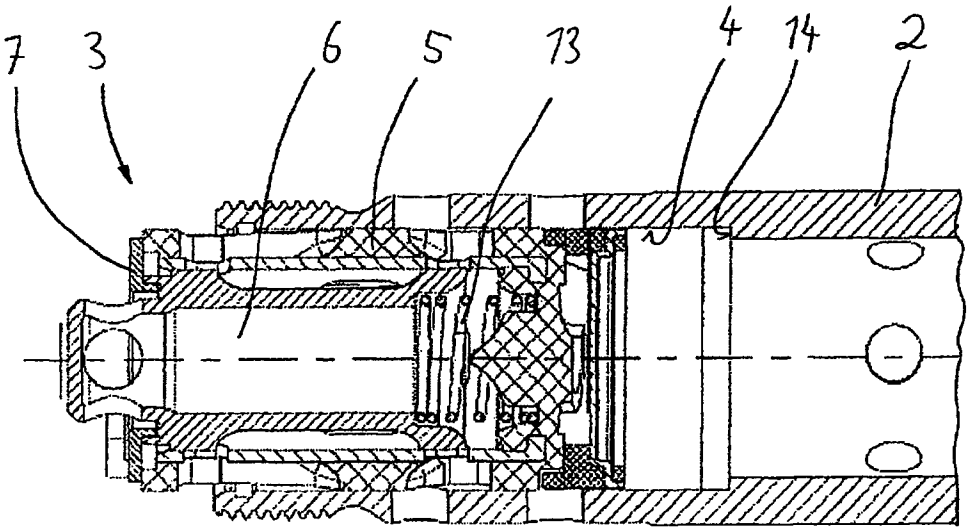
FIG. 7 shows the control valve during its insertion into the receiving bore in the camshaft.

FIG. 7 shows how the control valve 3 (as a preassembled unit, as can be seen in FIG. 3) is inserted into the bore 4 via the essential insertion path. The insertion force in this case is not exerted on the control piston, but on the front side of the circlip 7. The preassembled unit remains configured in this manner, as can be seen in FIG. 3.

Figure 8:
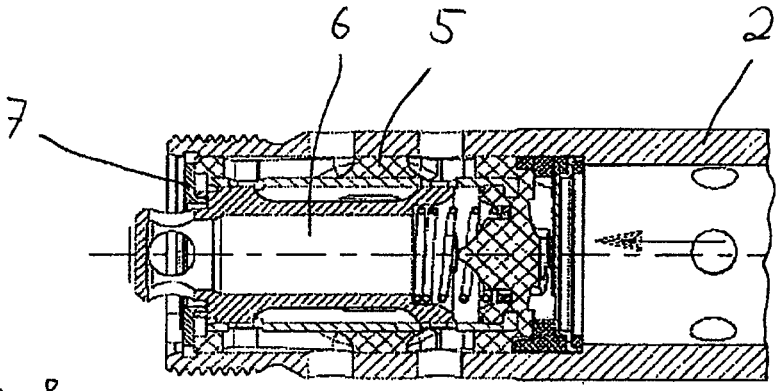
FIG. 8 shows the control valve following complete insertion into the receiving bore in the camshaft.

FIG. 8 shows how the control valve 3 has reached its final axial position in the bore 4, i.e. the right end of the control valve 3 has reached the ledge 14 (see FIG. 7). The control valve 3 still has its configuration, as illustrated in FIG. 3.

Figure 9:
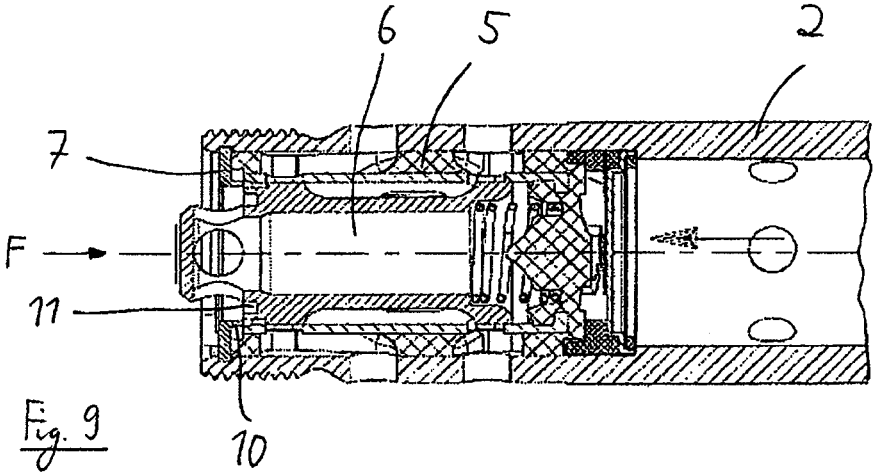
FIG. 9 shows the control valve in the representation according to FIG. 8, wherein the control piston has now been further inserted axially in the direction of the axis of the camshaft.
Figure 10:
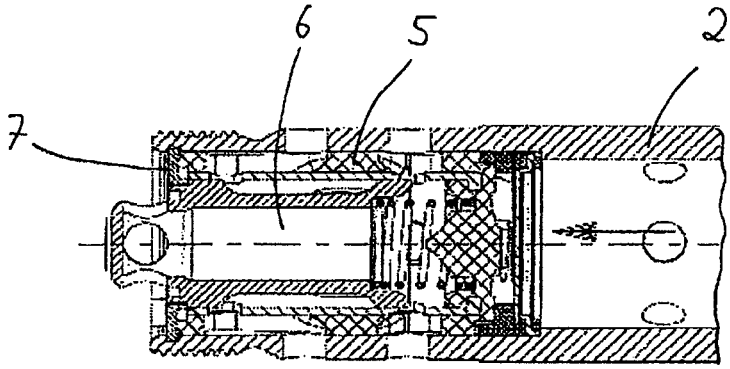
FIG. 10 shows the ready assembled configuration of the control valve in the camshaft and FIG. 11 shows the control valve as a preassembled unit in a slightly modified embodiment.

An axial force F is now applied to the control piston—as can be seen in FIG. 9. Consequently, the control piston 6 is displaced to the right relative to the valve housing 5 against the force of the spring element 13. The result is that the axially extending retaining portions 10 of the circlip 10 are removed from the annular groove 11 in the control piston 6, so that the circlip 7 can spring back radially outwards. It snaps into the annular groove 9 in the camshaft 2 and thereby secures the control valve 3 in the bore axially. The circlip 7 snapped into the annular groove 9 is illustrated in FIG. 9.

The force F can now be removed again—according to FIG. 10. The control piston 6 is in turn moved to the left due to the force of the spring element 13 and rests against the limit stop 15, formed by the axially extending retaining portions 10 (see FIG. 2 for this).

Figure 11:
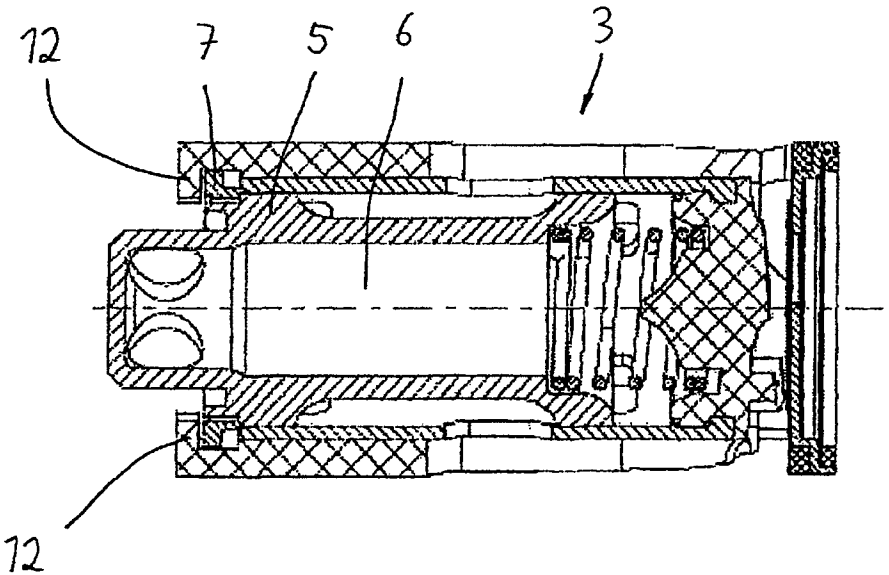

A slightly alternative variant of the control valve 3 is shown in FIG. 11.

According to this, the circlip 7 has the function of, on the one hand, holding the control valve together prior to final assembly in the camshaft adjuster and, on other hand, following assembly, both axially securing the valve housing 5 and also simultaneously creating an axial limit stop for the control piston 6.

Dismantling of the control valve 3 takes place such that the control piston 6 is in turn pressed in axially (as in FIG. 9). When this has happened, the circlip 9 is pushed together by means of a tool (pliers), so that it comes out of the annular groove 9. When the axial force is removed from the control piston 6, the axially extending retaining portions 10 in turn arrive in the front annular groove 11 in the control piston 6. The unit is therefore once again in the state, as shown in FIG. 3. In this position, the entire control valve 3 is then removed from the bore 4 in the camshaft again. Dismantling without further tools is therefore possible.

LIST OF REFERENCE NUMBERS

1 Device for varying the relative angle position (camshaft adjuster)
2 Camshaft
3 Control valve
4 Bore
5 Valve housing
6 Control piston
7 Circlip
8 Radially extending circumferential portion
9 Annular groove
10 Axially extending retaining portion
11 Annular groove
12 Hook-shaped portion
13 Spring element
14 Ledge
15 Limit stop
16 Circumferential point
17 Recess (bore)
18 Actuator

What is claimed is:

1. A device for varying the relative angle position of a camshaft with respect to a crankshaft of an internal combustion engine, comprising:

a drive element driven by the crankshaft;

a rotor connected to the camshaft in a non-rotatable manner;

at least two hydraulic chambers between the drive element and the rotor and actable upon by a hydraulic fluid in order to set a defined relative rotational position between the drive element and the rotor;

a control valve having a valve housing adapted to dimensions of a bore in the camshaft or the rotor, the control valve of substantially hollow cylindrical form and arrangeable in the bore;

a control piston arranged in an axially displaceable manner in the valve housing; and a circlip for fixing the valve housing in the camshaft or in the rotor in a form-fitting manner, the circlip having at least one radially extending circumferential portion designed to engage with an annular groove arranged in the camshaft or in the rotor in an axial end region of the camshaft or the rotor, the circlip having at least one axially extending retaining portion, the control piston having an annular groove in a control piston face region, which is designed for the engagement of at least one axially extending retaining portion, and the valve housing in a valve housing face region having at least one hook for engaging behind at least one circumferential portion of the circlip.

2. The device as recited in claim 1 wherein the circlip has an L-shaped design in the radial section, at least sectionally.

3. The device as recited in claim 1 further comprising a spring element effective in an axial direction and arranged between the valve housing and the control piston.

4. The device as recited in claim 1 wherein the bore in the camshaft or in the rotor has a ledge defining an axial limit stop for the valve housing.

5. The device as recited in claim 1 wherein the at least one axially extending retaining portion forms an axial limit stop for the control piston in an assembled state of the device.

6. The device as recited in claim 1 wherein the valve housing together with the control piston are configured by the circlip prior to assembly in the device as a preassembled unit, in that the at least one axially extending retaining portion is arranged in the annular groove of the control piston, while at the same time, a circumferential portion of the circlip is arranged under the hook.

7. The device as recited in claim 1 wherein the circlip has at least two axially extending retaining portions, the retaining portions arranged on opposite circumferential points of the circlip to one another.

8. The device as recited in claim 1 wherein the circlip has at least two radially extending circumferential portions arranged at opposite circumferential points of the circlip to one another.

9. The device as recited in claim 1 wherein the valve housing has two hooks arranged at opposite circumferential points of the valve housing to one another.

10. The device as recited in claim 1 wherein circlip has a gap at one circumferential point, wherein recesses for engagement of an assembly or dismantling tool are arranged in the portions of the circlip adjacent to the gap.

11. The device as recited in claim 10 wherein the recesses are bores.

* * * * *